US007918147B2

(12) United States Patent
Andersen

(10) Patent No.: US 7,918,147 B2
(45) Date of Patent: Apr. 5, 2011

(54) REMOVAL DEVICE FOR POUR TOP SPOUTS

(76) Inventor: Robert A. Andersen, Dunbarton, NH (US)

( * ) Notice: Subject to any disclaimer, the term of this patent is extended or adjusted under 35 U.S.C. 154(b) by 32 days.

(21) Appl. No.: 12/008,282

(22) Filed: Jan. 10, 2008

(65) Prior Publication Data

US 2009/0178514 A1 Jul. 16, 2009

(51) Int. Cl.
*B67B 7/00* (2006.01)

(52) U.S. Cl. ..... 81/3.55; 81/3.15

(58) Field of Classification Search ..... 81/3.55, 81/3.07, 3.09, 3.15, 3.27, 3.47, 3.48; 254/18, 254/21, 25, 27, 28, 113; 16/110.1, 426; D8/32, D8/42, 43, 88, 89
See application file for complete search history.

(56) References Cited

U.S. PATENT DOCUMENTS

| | | | | | |
|---|---|---|---|---|---|
| 889,556 | A * | 6/1908 | Stephens | 131/253 |
| D240,289 | S * | 6/1976 | Skinner | D8/40 |
| 4,836,059 | A * | 6/1989 | Arnold | 76/114 |
| 4,841,640 | A * | 6/1989 | Daniels | 30/294 |
| 5,535,644 | A * | 7/1996 | Paul-Alexandre et al. | 81/3.09 |
| 5,916,337 | A * | 6/1999 | Caniglia et al. | 81/3.15 |
| 6,257,553 | B1 * | 7/2001 | Khachatoorian | 254/25 |

* cited by examiner

*Primary Examiner* — D. S Meislin
(74) *Attorney, Agent, or Firm* — Lawson & Persson PC; Michael J. Persson; Catherin E. Napjus

(57) ABSTRACT

A removal device for removing an internal seal from a pour top spout, which includes a body having a curved central portion disposed between a first end portion and a second end portion that forms an included angle of less then one hundred and eighty degrees therebetween. At least a portion of the body has a cross section substantially formed in a shape of a closed plane curve and the outer surface of the body is dimensioned to fit within the opening of the ring of the internal seal of the pour top spout along the entire length of the body.

12 Claims, 7 Drawing Sheets

REMOVAL DEVICE FOR POUR TOP SPOUTS

FIELD OF THE INVENTION

The present invention relates to the field of hand-operated kitchen tools and, in particular, to a tool for removing internal seal rings from pour top spouts.

BACKGROUND OF THE INVENTION

Gable top paperboard containers have long been the containers of choice for refrigerated beverages, such as dairy products, orange juices, and the like. In the past, the method of discharging the liquid from a gable top container had been to tear open the sealed ridge of the gable top and pull out a foldable pour spout. However, this practice is objectionable because of the considerable manual effort involved, the hygienic problems arising from the direct manipulation of the pour spout panels from which the liquid is dispensed, and the inability to fully reseal the container, which may result in spillage and/or premature spoilage of the liquid stored therein.

In response to the problems inherent in traditional gable top paperboard container constructions, most producers have begun to employ a resealable fitment type pour spout on the containers. Such pour spouts are usually formed of plastic and attached to one of the slanted panels of the gable top over a pre-cut opening. In such constructions, the spout is conventionally provided with a screw cap closure. For dispensing with this type of container, the user unscrews the cap and removes an internal seal. Unfortunately, the removal of these internal seals is not an easy task for many people.

For many years, the most popular type of internal seal was a foil sheet that was bonded to the spout and peeled off by the user. However, these seals were very difficult to grasp, especially by those with limited manual dexterity, making them difficult to remove. Thus, it was common for users to simply pierce these seals with a knife or other object, which often caused them to fall into the container. Further, the cost of affixing an additional seal to the plastic spout was relatively high compared to the overall cost of the packaging.

In response to the problems associated with foil seals, a number of companies developed pour spouts with integral seals. Examples of these are shown in U.S. Pat. Nos. 5,133,486; 5,735,426 and 6,390,342. These spouts with integral seals are the most popular type of resealable pour spouts on the market today and each includes a scored area around the inside rim of the spout and a ring that is grasped by the user and pulled upward to break the seal along the score line. Because the ring must fit within the closed cap during storage, it does not extend a great distance above the spout when it is exposed, preventing the user from gaining significant leverage. Further, because of the type of plastic used in the manufacture of the spouts, and the need for the spout to be hermetically sealed during storage, it requires a significant amount of force to break the seal along the score line. The combination of the lack of leverage that can be exerted on the ring and the high force required to break the seal makes the task difficult, if not impossible, for many people. Finally, the high force required to break the seal, coupled with the fact that only a single finger may be inserted into the ring, often causes pain or other discomfort to the user's finger.

Similar problems were experienced in the past in connection with the removal of pull tops from beer and soft drink cans prior to their universal redesign in the 1970's. In response to these problems, a number of hand-operated tools were developed to allow the tops to be more easily removed.

However, none of these are adapted to remove the integral seals of resealable pour spouts attached to today's gable top containers.

One example of such a tool is shown in U.S. Pat. No. 4,241,626, titled "Opener device for sealed cans". This patent discloses a rod-like tool having a handle on one end and a series of notches on the opposite end. One of the notches at the end opposite the handle hooks into the pull-tab and the other notches are on the opposite side and serve as a holding means on the rim of the can be opened and concurrently as a fulcrum point for the lever action to lift the pull-tab and thereby opening the can.

The device of U.S. Pat. No. 4,241,626 appears to be effective at removing pull-tabs from metal cans. However, it is not adapted for use in removing the seals from pour spouts attached to gable top containers. First, the device uses notches on the rod to hold onto the rim of the can and act to hold it in place and to serve as a fulcrum. While a can is sufficiently rigid to allow it to be used as a stable fulcrum point for the rod, a gable top container is not sufficiently rigid and, even if the rod could be adapted to grip some portion of the container, the gable top would collapse under the force exerted thereby. In addition, the fact that the rod is a straight rod makes it unsuited for insertion within the ring of the seal of the pour top spout. This is due to the insufficient clearance between the rod and the gable top, which makes it difficult or impossible for the user to grasp the rod and exert a reasonable amount of force thereon and limits how far the rod may be angled without contacting and collapsing the gable top of the container.

Another example of a tool for removing pull-tops is shown in U.S. Pat. No. 5,309,794, titled "Opening device for cans having tear-away closure panels with ring tabs". This patent discloses an opening device for cans, such as soup cans, canned fruits, and the like, which have a tear-away closure panel that is defined by a circular score line adjacent the rim of the can. The device has a generally circular perimeter, a handle opposite the perimeter, and a recess in the perimeter formed by a narrow mouth and two opposed prongs. The opener is operated by wedging a prong beneath the ring tab to pry it upwardly and break the score line at one end. Then the device is rolled toward the opposite side of the can, pulling the closure panel upwardly while continuing to break the score line until the closure panel is removed from the can.

As was the case with the opener of U.S. Pat. No. 4,241,626, the opener of U.S. Pat. No. 5,309,794 requires that the opener contact the can and use it to generate the force required to break the score line of the seal. Therefore, it also may only be used on rigid cans. Further, although it has a handle that is accessible by the user's hand, the recess that is used to engage the ring of the can is not readily adapted for gripping and pulling the ring of the seal of the pour top spout in an upward direction, as is required if the seal is to be removed without the device contacting the container.

Still another example of a tool for removing pull-tops is shown in U.S. Pat. No. 5,555,778, titled "Can opener for pull top cans". This patent discloses an opener tool manufactured of a substantially flat piece of metal that has a working end, a convexly curved underside portion and a handle. The working end is dimensioned for insertion under the ring portion of a pull-tab without lifting the pull-tab ring sufficiently to break the seal of the can top and has a smaller width than the curved portion, which acts a stop element for limiting insertion of the working end through the finger opening of the ring. In operation, the working end of the devices is inserted under the ring portion of the pull-tab, the curved portion engages the top of the can, and the handle is rotated such that the curved portion acts as a fulcrum for the working end, which moves upward to remove the pull-tab.

The device of U.S. Pat. No. 5,555,778 is similar to those of U.S. Pat. Nos. 4,241,626 and 5,309,794 insofar as it requires that the opener contact the can and use it to generate the force required to break the score line of the seal. Therefore, it also may only be used on rigid cans. Further, as the stop element prevents the pull-tab from resting within the curved central portion and the working end is not adapted to effectively grasp the pull-top when at an angle other than that created by the intended fulcrum action, it cannot be used to engage the tab and pull it from the container without contacting it. Finally, it is noted that even if this device were dimensioned such that the ring could pass through to the curved portion of the device, its flat cross section would not provide the user with a comfortable gripping surface and the exertion of the upward force required to remove the ring would be likely to hurt the user's hands.

Therefore, there is a need for a device that is adapted to engage the rings of the integral seals of resealable pour spouts attached to gable top paper containers and remove these seals, that does not require the use of a rigid fulcrum point to create sufficient force to remove the seal, that will not crush the container when in use, that cannot be disengaged from the ring during use, that provides sufficient clearance between the device and the gable top when the ring is engaged so as to allow the user to grasp the devices and avoid contacting the gable top of the container during operation, that provides the user with a comfortable gripping surface, and that will not hurt the user's hands or fingers during use.

SUMMARY OF THE INVENTION

The present invention is a removal device for removing an internal seal from a pour top spout, the removal device in combination with a gable top container, and a method for removing an internal seal from a pour top spout using the removal device, that solves the problems described above and overcomes the drawbacks inherent in the prior art.

In its most basic form, the removal device includes a body having first end, a first end portion disposed proximate to the first end, a second end, a second end portion disposed proximate to the second end, a curved central portion disposed between the first end portion and the second end portion, and an outer surface extending about the first end portion, the curved central portion and the second end portion. An included angle of less then one hundred and eighty degrees is formed by a first line disposed in perpendicular relation to a center of the first end and a second line disposed in perpendicular relation to a center of the second end. At least a portion of the body has a cross section substantially formed in a shape of a closed plane curve and the outer surface of the body is dimensioned fit within the opening of the ring of the internal seal of the pour top spout along the entire length of the body.

In the preferred device, the included angle is between one hundred and thirty five degrees and one hundred and fifty five degrees, with the angle preferably being in the range of one hundred and forty degrees and one hundred and forty five degrees.

In the preferred device, the shape of the closed plane curve is the shape of a circle. In such embodiments, the circle has a diameter of between 0.375 inches and 0.625 inches. However, the shape of a closed plane curve is an ellipse and an oval in other embodiments.

The preferred device also includes a plurality of finger depressions extending into the outer surface of the body. These depressions are preferably spaced and sized to accommodate the fingers of an average sized hand and there are preferably two or more such depressions.

Some embodiments of the device include at least one symbol disposed upon the outer surface of the body. These symbols may be words, designs, or a combination of both and it is envisioned that inexpensive versions of the device will be given away as promotional items bearing the name and/or logo of the company giving them away. In some such embodiments, the outer surface of the body has at least one substantially planar surface and symbols are disposed upon the substantially planar surface. In other embodiments, the symbols are embossed or stamped into the outer surface of the body using art-recognized methods.

In some embodiments, one or more ends of the device are dimensioned to perform other tasks. For example, in one such embodiment, at least one of the first end and the second end is chisel shaped end and dimensioned to slide under a tab mounted parallel to a top of a can. In another such embodiment, at least one of the first end and the second end comprises bottle opener means adapted to remove a crimped metal top from a glass bottle. In another embodiment, one of the first end and the second end is substantially hollow and the device also includes a corkscrew dimensioned for insertion within the substantially hollow end. In still other embodiments, one or more combinations of these end tools are provided.

As noted above, the present invention also contemplates a combination of the removal device and a gable top container. In such embodiments, the gable top container includes a pour spout attached to a gable top of the gable top container. The pour spout has an internal seal and the internal seal has a score line and a ring having an opening therethrough.

In some embodiments, the opening in the ring of the seal of the gable top container has an inside diameter of between 0.4375 inches and 0.6875 inches, the shape of a closed plane curve of the cross section of the body is a shape of a circle, and the circle has a diameter of between 0.375 inches and 0.625 inches.

The method of removing an internal seal from a pour top spout includes the steps of removing the replaceable cap from the pour top spout and bending the ring of the internal seal upward such that the ring extends above an open edge of the pour top spout. Once extended, the removal device is operated by inserting the removal device through the opening in the ring, positioning the removal device within the opening in the ring such that the ring rests upon the curved central portion of the body of the removal device and such that the first end portion extends from one side of the ring and the second end portion extends from another side of the ring, grasping the removal device with one hand such that at least one finger rests upon the outer surface of the first end portion and such that at least one finger rests upon the outer surface of the second end portion, grasping the gable top container with another hand, and rotating one end of the removal device upward such that neither the removal device nor the user's hand come into contact with the container and such that the internal seal is removed.

Therefore, it is an aspect of the invention to provide a device that is adapted to engage the rings of the integral seals of resealable pour spouts attached to gable top paper containers and remove these seals.

It is a further aspect of the invention to provide a device for removing the integral seals of resealable pour spouts attached to gable top paper containers that does not require the use of a rigid fulcrum point to create sufficient force to remove the seal.

It is a further aspect of the invention to provide a device for removing the integral seals of resealable pour spouts attached to gable top paper containers that will not crush the container when in use.

It is a further aspect of the invention to provide a device for removing the integral seals of resealable pour spouts attached to gable top paper containers that cannot be disengaged from the ring during use.

It is a further aspect of the invention to provide a device for removing the integral seals of resealable pour spouts attached to gable top paper containers that provides sufficient clearance between the device and the gable top when the ring is engaged so as to allow the user to grasp the devices and avoid contacting the gable top of the container during operation.

It is a further aspect of the invention to provide a device for removing the integral seals of resealable pour spouts attached to gable top paper containers that provides the user with a comfortable gripping surface.

It is a still further aspect of the invention to provide a device for removing the integral seals of resealable pour spouts attached to gable top paper containers that will not hurt the user's hands or fingers during use.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
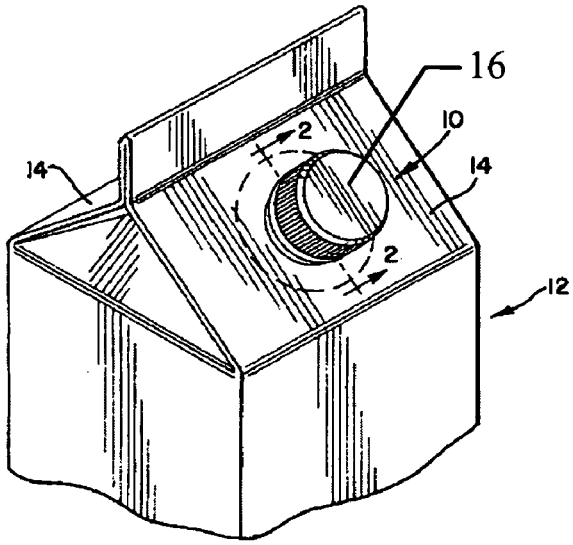
FIG. 1 PRIOR ART
FIG. 1 is an isometric view of a prior art gable top container to which a resealable pour spout is attached.
Figure 2:
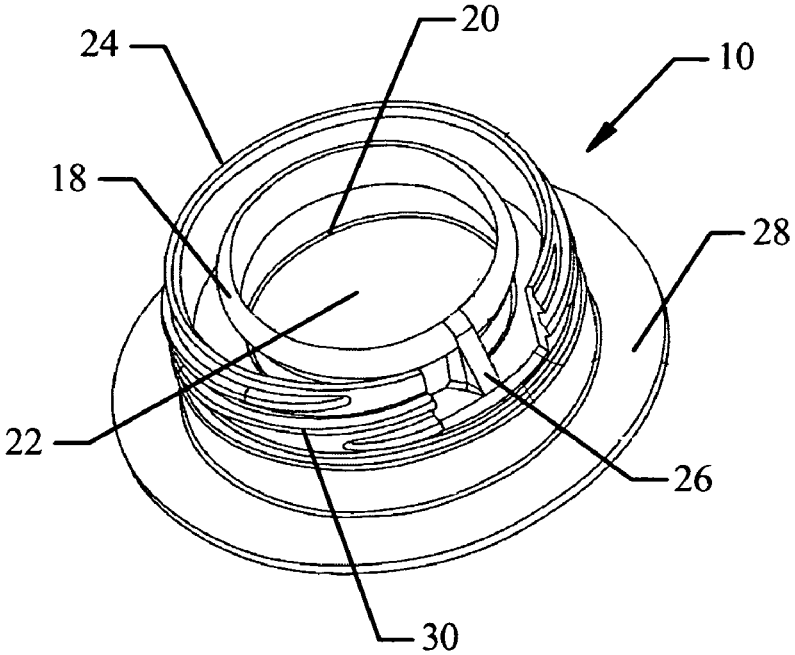
FIG. 2 PRIOR ART
FIG. 2 is an isometric view of a prior art resealable pour spout with a portion cut away to show the extending post, ring and internal seal.

Referring first to FIGS. 1 and 2, the present invention is used to remove the internal seal 22 from the pour top spout 10 attached to the gable surface 14 of a gable top container 12. The pour top spout 10 typically includes a replaceable cap 16 that attaches to a threaded cylinder 30 that extends upward from a base portion 28 that is affixed to the gable surface 14 of the gable top container 12 and terminates in a top edge 24. The internal seal 22 is joined to the inside of the threaded cylinder 30 along a score line 20. The score line 20 is typically an area of reduced thickness that provides a point of weakness in the internal seal 22 that may be fractured when a sufficient force is applied to the internal seal 22. Force is applied to the internal seal 22 through a ring 18 that typically attaches to the internal seal 22 by an extending post 26 that is formed integral to the ring 18 and internal seal 22. In operation, a user grasps the gable top container 12 with one hand and the ring 18 with the other and pulls the ring 18 upward with sufficient force to fracture the internal seal 22 along the score line 20 such that the internal seal 22 may be removed.

Figure 3:
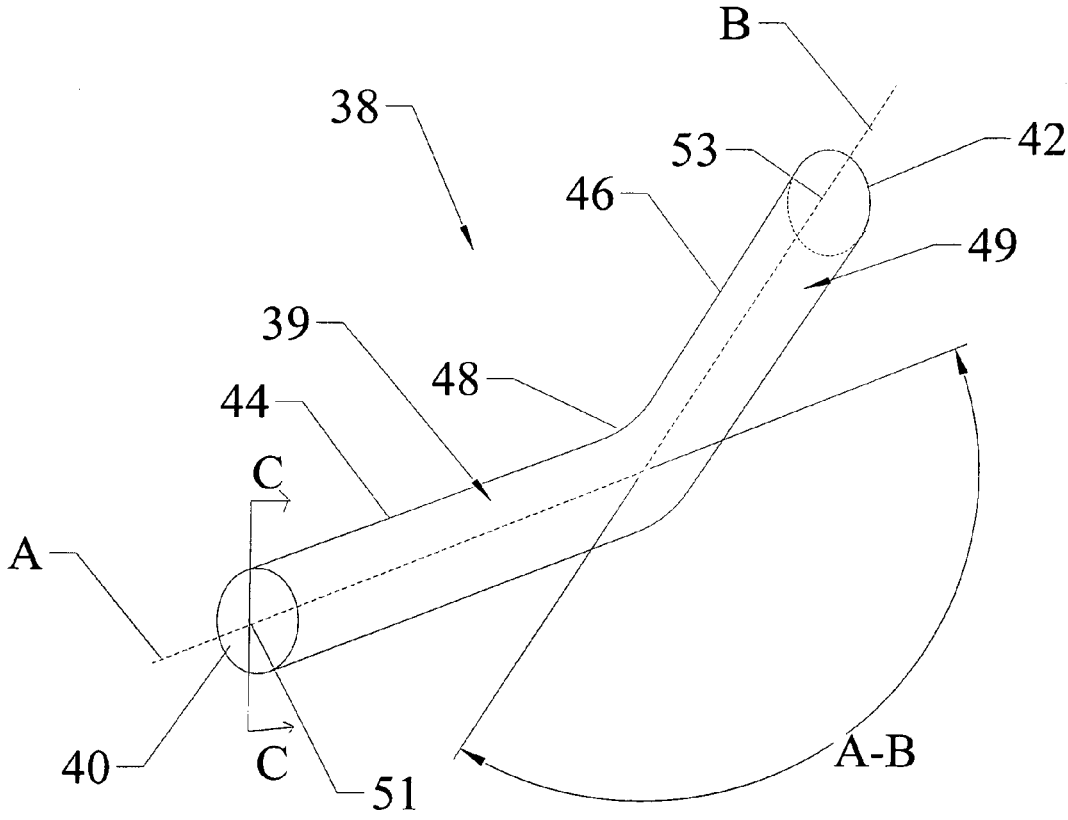
FIG. 3 is an isometric view of a basic embodiment of the removal device of the present invention having a circle shaped cross section.
Figure 4A:
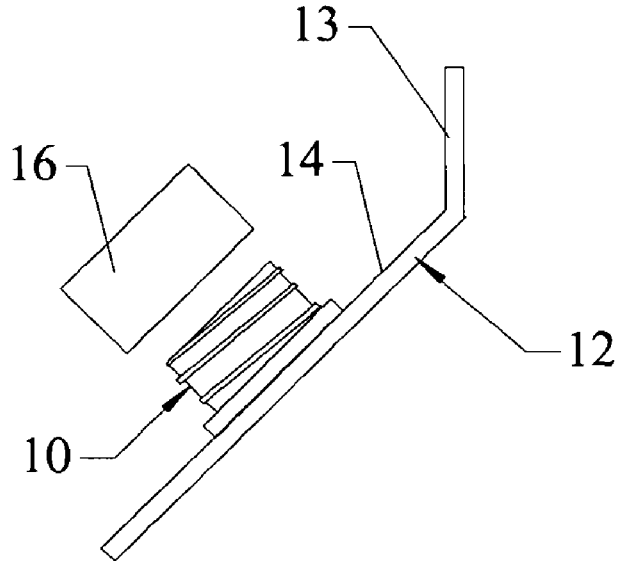
FIG. 4A is a side view of the top portion of a prior art gable top container to which a resealable pour spout is attached.
Figure 4B:
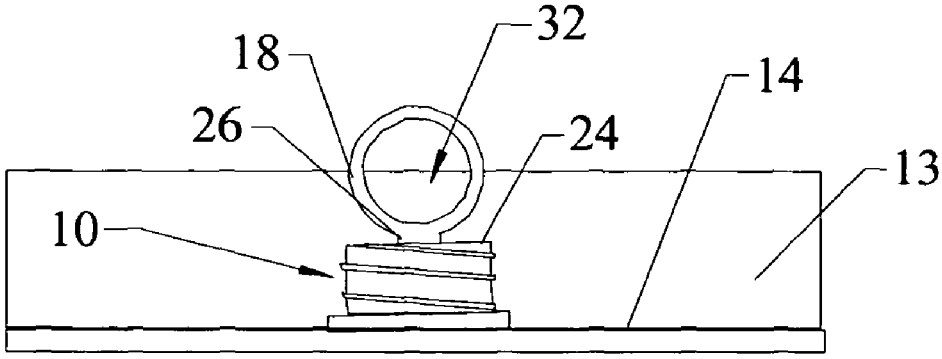
FIG. 4B is a front view of the container and pour spout of FIG. 4A taken along the plane of the gable top and showing the ring of the internal seal exposed to show the opening therein.
Figure 4C:
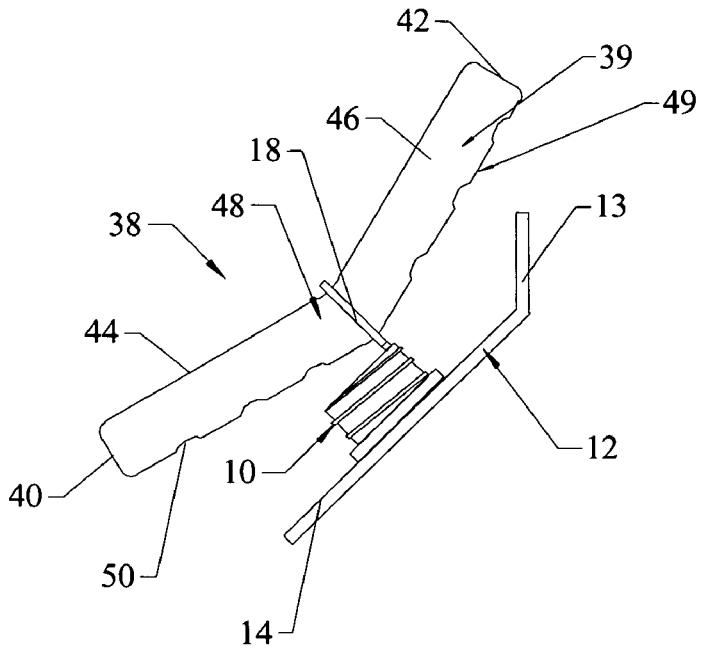
FIG. 4C is a side view of the container and pour spout of FIGS. 4A and 4B with a preferred embodiment of the removal device of the present invention inserted therein.
Figure 4D:
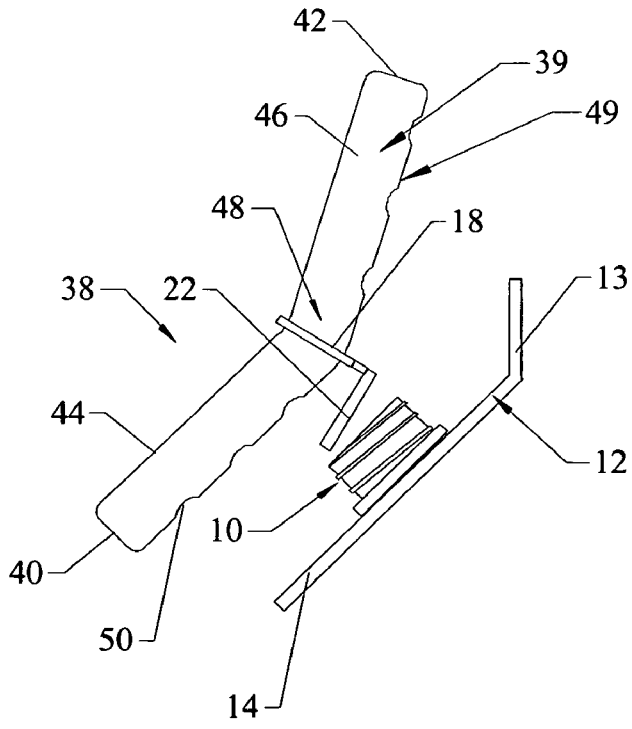
FIG. 4D is a side view of the container, pour spout and removal device of FIG. 4C showing the position of the device and internal seal upon removal.

Referring now to FIGS. 3-4D, the removal device 38 of the present invention includes a body 39 having first end 40, a first end portion 44 disposed proximate to the first end 40, a second end 42, a second end portion 46 disposed proximate to the second end, a curved central portion 48 disposed between the first end portion 44 and the second end portion 46, and an outer surface 49 extending about the first end portion 44, the curved central portion 48 and the second end portion 46.

The removal device 38 is preferably formed from an inexpensive material, such as a plastic material, that has sufficient rigidity to avoid deflection and/or breakage during use. Although plastic materials are preferred, it is understood that some embodiments may be manufactured from metal, wood, or composites. Still others may utilize a combination of materials. For example, in the embodiment of FIG. 5, the curved central portion 48 has a larger cross section than the first end portion 44 and the second end portion 46 and a pair of grips 82 are fitted over the first end portion 44 and second end portion 46. Regardless of what materials are used, all embodiments of the removal device 38 are dimensioned such that the outer surface 49 of the body 39 is dimensioned to fit within the opening 32 (as shown in FIG. 4B) of the ring 18 of the internal seal 22 of the pour top spout 10 along the entire length of the body 39 of the removal device 38.

The curved central portion 48 of the removal device 38 forms an included angle A-B between the first end portion 44 and second end portion 46. First end portion 44 includes first end 40 with center 51. Second end portion 46 includes second end 42 with center 53. The included angle A-B is less than one hundred and eighty degrees when measured between a first line A and a second line B. The included angle A-B is dimensioned to provide sufficient clearance between the removal device 38 and the gable surface 14 of the gable top container 12 when the ring 18 is engaged so as to allow the user to grasp the removal device 38 without their fingers, or the removal device 38, contacting the gable surface 14 of the gable top container 12. In the preferred embodiment, the included angle A-B is between one hundred and thirty five degrees)(135°) and one hundred and fifty five degrees)(155°), with the included angle A-B most preferably being in the range of one hundred and forty degrees)(140°) and one hundred and forty five degrees)(145°).

Figure 5:
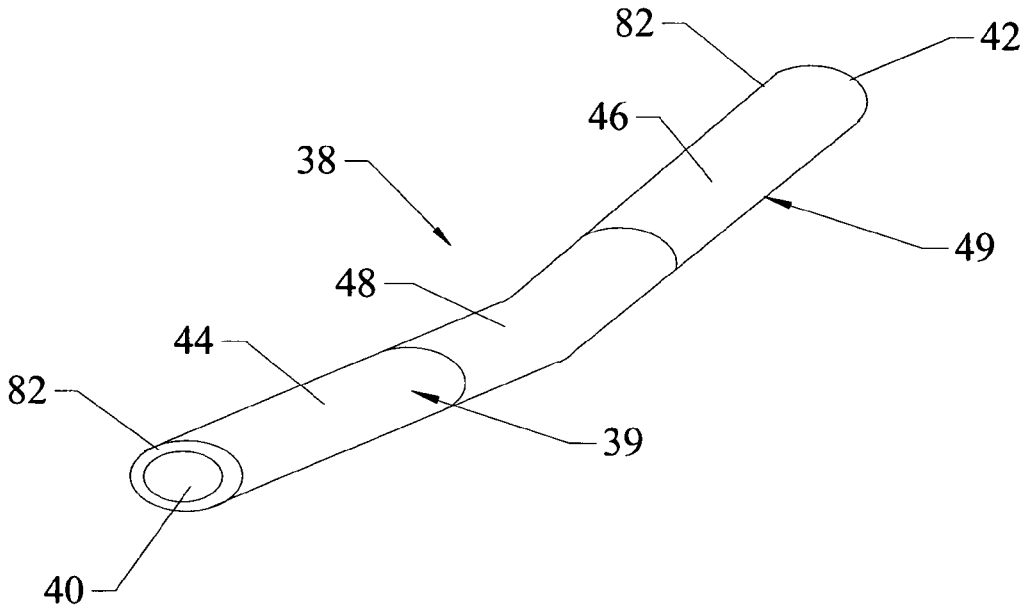
FIG. 5 is an isometric view of an alternative embodiment of the removal device having an elliptical shaped cross section.
Figure 6:
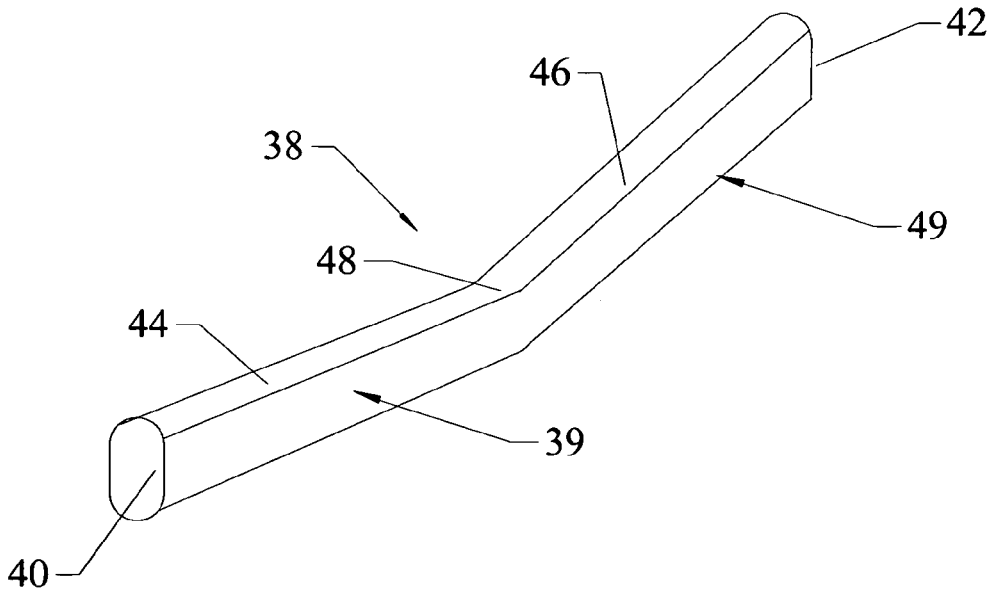
FIG. 6 is an isometric view of an alternative embodiment of the removal device having an oval shaped cross section.

At least a portion of the body 39 has a cross section C-C substantially formed in a shape of a closed plane curve. In the embodiment of FIG. 3, the shape of the closed plane curve is the shape of a circle and this cross section C-C remains substantially constant from the first end 40 to the second end 42. The outer surface 49 of the body 39 is dimensioned to fit within the opening 32 of the ring 18 of the internal seal 22 of the pour top spout 10 along the entire length of the body 39. Accordingly, the circle cross section C-C preferably has a diameter of between 0.375 inches and 0.625 inches in order to be slightly smaller than the diameter of the opening through the ring 18 into which it is inserted, which is typically between 0.4375 inches and 0.6875 inches. The formation of a removal device 38 with a body 39 having a circle shaped cross section C-C that remains substantially constant along its length is preferred as round material is readily available and may be easily cut into desired lengths and formed into the removal device 38 of the present invention. However, the shape of the closed plane curve may be an ellipse, as shown in FIG. 5, an oval, as shown in FIG. 6, or any other curved shape. Further, in some embodiments, such as those in FIGS. 5, 8 and 9, the cross section of body 39 is not constant from one end to the other. In such embodiments, the removal device 38 is preferably manufactured by injection molding or by performing additional machining operations on a rolled or extruded material to form the body 39. Finally, it is noted that the overall length of the removal device 38 is preferably between four and five inches, although other embodiments may have longer lengths.

As shown in FIGS. 4A-4D, the preferred embodiment of the removal device 38 also includes a plurality of finger depressions 50 extending into the outer surface 49 of the body 39 along the bottom thereof. These finger depressions 50 are preferably spaced and sized to accommodate the fingers of an average sized hand. There are preferably two or more such finger depressions 50 disposed upon each of the first end portion 44 and second end portion 46 such that two fingers may be disposed upon either side of the ring 18 during use. The inclusion of finger depressions 50 is preferred as they provide a more ergonomic and comfortable gripping surface for the fingers of the user. However, in other embodiments, such as the embodiment of FIG. 5, the finger depressions 50 are eliminated and the first end portion 44 and second end portion 46 are fitted with flexible grips 82. In such embodiments, these grips 82 are preferably manufactured of a rubber material and provide increased cushioning to the hands of the user.

Referring now to FIGS. 4A-4D, the method of using the removal device 38 to open the pour top spout 10 of a gable top container 12 is explained. As shown in FIG. 4A, the first step is to remove the replaceable cap 16 from the pour top spout 10. The user then inserts a finger into the opening 32 in the ring 18 and bends the ring 18 upward about the extending post 26 such that the ring 18 extends above the top edge 24 of the pour top spout 10, which results in the ring 18 being in the position shown in FIG. 4B. Once the ring 18 is extended, the removal device 38 is inserted through the opening 32 in the ring 18 and positioned within the opening 32 in the ring 18 such that the ring 18 rests upon the curved central portion 48 of the body 39 of the removal device 38 and such that the first end portion 44 extends from one side of the ring 18 and the second end portion 46 extends from another side of the ring 18. This results in the removal device 38 being positioned as shown in FIG. 4C. The user then grasps the removal device 38 with one hand (not shown) such that at least one finger (not shown) rests upon the outer surface 49 of the first end portion 44 and such that at least one finger rests upon the outer surface 49 of the second end portion 46. The user then grasps the gable top container 12 with another hand (not shown), and rotates the second end 42 of the removal device 38 upward such that neither the removal device 38 nor the users fingers come into contact with the gable top container 12 and such that the internal seal 22 is removed, as shown in FIG. 4D.

Figure 7:
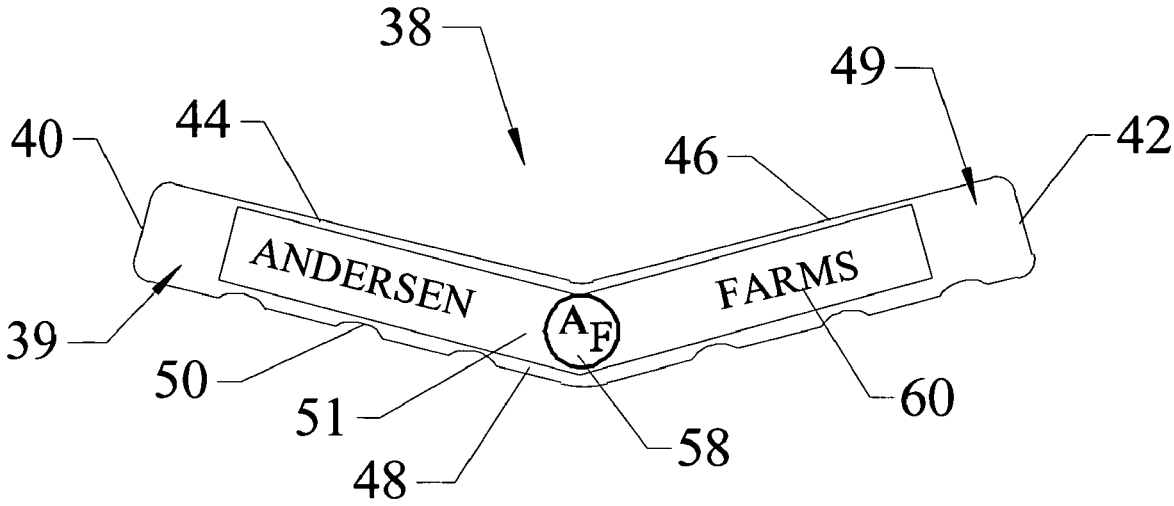
FIG. 7 is a side view of one embodiment of the removal device with advertising material printed on its side.

Referring now to FIG. 7, it is anticipated that the removal device 38 will be used as a promotional item that may be removably attached to a gable top container 12 and display the name and/or logo of the manufacturer of the product being sold in the gable top container 12. In such embodiments, at least one symbol 60 is disposed upon the outer surface 49 of the body 39 of the removal device 38. These symbols 60 may be words, designs 58, or a combination of both. In the embodiment of FIG. 7, the outer surface 49 of the body 39 has at least one substantially planar surface 51 and the symbols 60 are disposed upon this planar surface 51. However, in other embodiments there is no planar surface 51 and the symbols 60 are embossed or stamped into the outer surface 49 of the body 39 using art-recognized methods.

Figure 8:
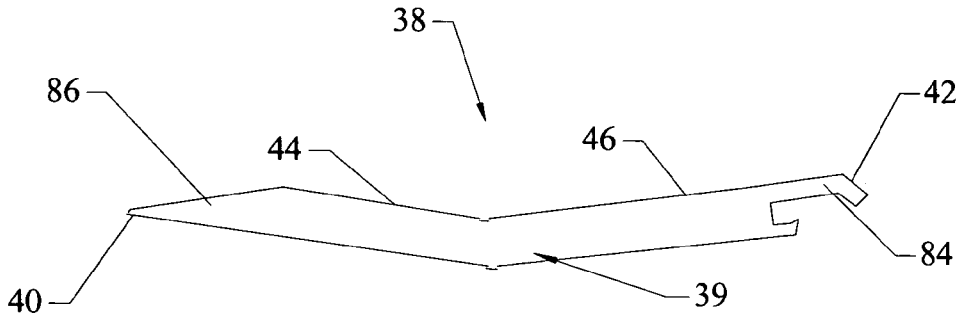
FIG. 8 is a side view of one embodiment of the removal device with a chisel shaped first end and a second end having an integral bottle opener.
Figure 9:
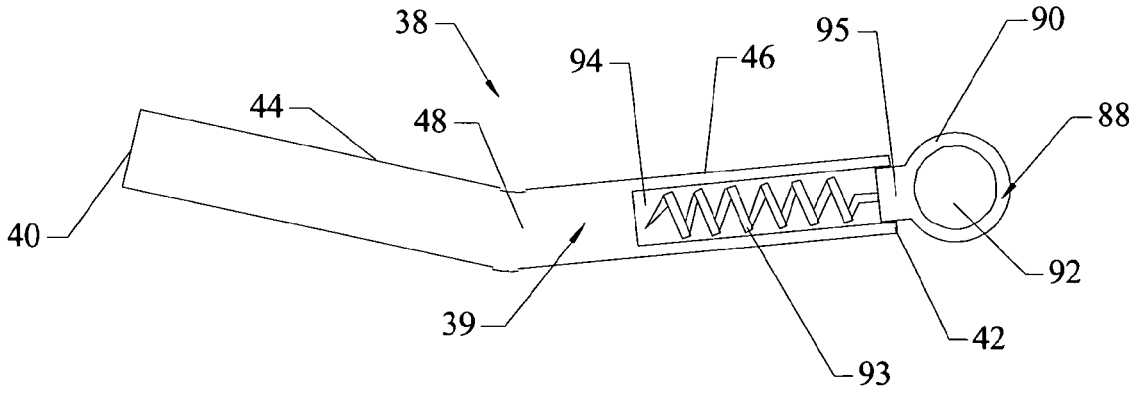
FIG. 9 is a side view of one embodiment of the device having a hollow end into which a corkscrew is fitted.

Referring now to FIGS. 8 and 9, some embodiments of the removal device have ends 40, 42 that are adapted to perform other tasks. In the embodiment of FIG. 8, the first end portion 44 is sloped toward the first end 40 to form a chisel shaped end 86 that is dimensioned to slide under a tab mounted parallel to a top of a can (not shown), such as a beer or soft drink can. In operation, the user would slide the chisel shaped end 86 under the tab on the can and rotate the second end 42 of the removal device 38 upward to open the can. The second end 42 of the embodiment of FIG. 8 includes a bottle opener 84 that is adapted to remove crimped metal tops from glass bottles (not shown), such as beer bottles. Although the embodiment of FIG. 8 shows this bottle opener 84 as being integral to the body 39, it is recognized that the bottle opener 84 may be a separate item that is removably attached to the second end 42 of the body 39. In such embodiments, the bottle opener 84 may be larger than the body 39 and would be removed when the user wishes to use the removal device 38 to remove a ring 18 from a gable top container 12. Similarly, although the claw type bottle opener 84 of FIG. 8 is preferred due to its low profile, other styles may be utilized to achieve similar results.

FIG. 9 shows an embodiment of the removal device 38 that includes an integral corkscrew 88. In such embodiments, the body 39 of the removal device 38 has a circular cross section and the second end 42 of the removal device 38 is substantially hollow and includes round bore 94 dimensioned to accept the screw portion 93 of the corkscrew 88. The corkscrew 88 is preferably a traditional style ring and screw type corkscrew that includes a screw portion 93 that attaches to a cylindrical base 95 and a ring portion 90 having an opening 92 therethrough that is dimensioned to allow the body 39 of the removal device 38 to pass through and engage it. The cylindrical base 95 is dimensioned to engage the inside surface of the round bore 94 within the body 39 such that it remains engaged when not in use and may be easily removed when the removal device 38 is to be used. In the embodiment of FIG. 9, this engagement is a frictional engagement, but other embodiments secure the cylindrical base 95 within the round bore 94 by means of mating threads.

Finally, although the first end 40 of the removal device 38 shown in FIG. 9 does not perform any other tasks, it is recognized that the chisel shaped end 86 or bottle opener 84 of the embodiment of FIG. 8 may be utilized thereon. Similarly, the first end 40 may include a triangular style can opener or other device that is useful in the kitchen. In still other embodiments, one or more combinations of these end tools are provided.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. In combination:

a gable top container comprising a pour spout attached to a gable top of said gable top container;

wherein said pour spout comprises an internal seal; and wherein said internal seal comprises a score line and an internal ring having an opening therethrough; and a removal device comprising:

a body comprising a first end, a first end portion disposed proximate to said first end, a second end, a second end portion disposed proximate to said second end, a curved central portion disposed between said first end portion and said second end portion, and an outer surface extending about said first end portion, said curved central portion and said second end portion;

wherein an included angle formed by a first line extending through a center of said first end and a second line extending through a center of said second end is less than one hundred and eighty degrees;

wherein at least a portion of said body has a cross section substantially formed in a shape of a closed plane curve; and wherein said outer surface of said body is dimensioned to fit within the opening of the ring of the internal seal of the pour top spout along an entire length of said body;

wherein said included angle of said body of said removal device is between one hundred and thirty five degrees and one hundred and fifty five degrees.

2. The combination as claimed in claim 1 wherein said opening in said internal ring of said seal of said gable top container has an inside diameter of between 0.4375 inches and 0.6875 inches, wherein said shape of a closed plane curve of said cross section of said body is a shape of a circle, and wherein said circle has a diameter of between 0.375 inches and 0.625 inches.

3. The combination as claimed in claim 1 wherein said shape of a closed plane curve is a shape chosen from a group consisting of an ellipse and an oval.

4. The combination as claimed in claim 1 further comprising at least one symbol disposed upon said outer surface of said body.

5. The combination as claimed in claim 1 further comprising a plurality of finger depressions extending into said outer surface of said body.

6. The combination as claimed in claim 1 wherein at least one of said first end and said second end comprises a means selected from a group consisting of a can tab rotating means for sliding under a tab mounted parallel to a top of a can and rotating said tap upward, a bottle opener means adapted for removing a crimped metal top from a bottle, and a cork removing means for removing a cork from a bottle.

7. A method for removing an internal seal from a pour top spout, wherein the internal seal includes a score line and a ring having an opening therethrough, wherein the pour top spout is attached to a gable top of a container, and wherein said pour top spout includes a replaceable cap, said method comprising the steps of:

removing the replaceable cap from the pour top spout;

bending the ring of the internal seal upward such that the ring extends above an open edge of the pour top spout;

inserting a removal device through the opening in the ring, wherein said removal device Comprises a body having a first end, a first end portion disposed proximate to said first end, a second end, a second end portion disposed proximate to said second end, a curved central portion disposed between said first end portion and said second end portion, and an outer surface extending about said first end portion, said curved central portion and said second end portion; wherein an included angle formed by a first line extending through a center of said first end and a second line extending through a center of said second end is less than one hundred and eighty degrees; wherein at least a portion of said body has a cross section substantially formed in a shape of a closed plane curve; and wherein said outer surface of said body is dimensioned to fit within the opening of the ring of the internal seal of the pour top spout along an entire length of said body;

positioning said removal device within the opening in the ring such that the ring rests upon said curved central portion of said body of said removal device and such that said first end portion extends from one side of the ring and said second end portion extends from another side of said ring;

grasping said removal device with one hand such that at least one finger rests upon said outer surface of said first end portion and such that at least one finger rests upon said outer surface of said second end portion;

grasping said gable top container with another hand; and rotating one end of said removal device upward such that said removal device does not come into contact with said container and such that said internal seal is removed.

8. In combination:

a gable top container comprising a pour spout attached to a gable top of said gable top container;

wherein said pour spout comprises an internal seal;

wherein said internal seal comprises a score line and an internal ring having an opening therethrough; and wherein said opening in an internal ring of said seal of said gable top container has an inside diameter of between 0.4375 inches and 0.6875 inches, wherein said shape of a closed plane curve of said cross section of said body is a shape of a circle, and wherein said circle has a diameter of between 0.375 inches and 0.625 inches; and a removal device comprising:

a body comprising a first end, a first end portion disposed proximate to said first end, a second end, a second end portion disposed proximate to said second end, a curved central portion disposed between said first end portion and said second end portion, and an outer surface extending about said first end portion, said curved central portion and said second end portion;

wherein an included angle formed by a first line extending through a center of said first end and a second line extending through a center of said second end is less than one hundred and eighty degrees;

wherein at least a portion of said body has a cross section substantially formed in a shape of a closed plane curve; and wherein said outer surface of said body is dimensioned to fit within the opening of the ring of the internal seal of the pour top spout along an entire length of said body.

9. The combination as claimed in claim 8 wherein said shape of a closed plane curve is a shape chosen from a group consisting of an ellipse and an oval.

10. The combination as claimed in claim 8 further comprising at least one symbol disposed upon said outer surface of said body.

11. The combination as claimed in claim 8 further comprising a plurality of finger depressions extending into said outer surface of said body.

12. The combination as claimed in claim 8 wherein at least one of said first end and said second end comprises a means selected from a group consisting of a can tab rotating means for sliding under a tab mounted parallel to a top of a can and rotating said tap upward, a bottle opener means adapted for removing a crimped metal top from a bottle, and a cork removing means for removing a cork from a bottle.

* * * * *